US005333353A

United States Patent [19]

Taylor

[11] Patent Number: 5,333,353

[45] Date of Patent: Aug. 2, 1994

[54] MOP WRINGERS AND BUCKETS

[75] Inventor: Michael Taylor, Lower Norton, England

[73] Assignee: Scot Young Research Limited, West Midlands, United Kingdom

[21] Appl. No.: 964,774

[22] Filed: Oct. 22, 1992

Related U.S. Application Data

[63] Continuation-in-part of Ser. No. 655,326, Feb. 12, 1991, abandoned.

[30] Foreign Application Priority Data

Feb. 13, 1990 [GB] United Kingdom ..... 9003175.8

[51] Int. Cl.[5] ..... A47L 13/58

[52] U.S. Cl. ..... 15/264; 15/260; 15/261

[58] Field of Search ..... 15/260, 261, 262, 263, 15/264; 100/132; 220/DIG. 9, 91, 675, 571.1, 572, 605, 606, 635, 694, 695, 697, 699, 700, 701, 702, 729

[56] References Cited

U.S. PATENT DOCUMENTS

| | | | |
|---|---|---|---|
| 943,750 | 12/1909 | Leeking | 220/572 |
| 1,157,152 | 10/1915 | Davis | 15/261 |
| 1,351,805 | 9/1920 | Speckman . | |
| 1,918,986 | 7/1933 | Schulman . | |
| 2,023,133 | 12/1935 | Gringer . | |
| 2,296,808 | 9/1942 | Chaplin | 220/675 |
| 3,025,996 | 3/1962 | Habich et al. | 220/694 |
| 3,044,096 | 7/1962 | Englehart | 15/260 |
| 3,921,247 | 11/1975 | Cook | 15/262 |
| 4,888,847 | 12/1989 | Montijo | 15/263 |
| 4,905,339 | 3/1990 | Taylor | 15/262 |

FOREIGN PATENT DOCUMENTS

| | | | |
|---|---|---|---|
| 254507 | 1/1988 | European Pat. Off. . | |
| 8602248 | 4/1986 | PCT Int'l Appl. | 15/262 |
| 282991 | 9/1952 | Switzerland . | |
| 27444 | of 1910 | United Kingdom | 15/260 |
| 510517 | 7/1939 | United Kingdom . | |
| 2176094 | 12/1986 | United Kingdom | 15/262 |

*Primary Examiner*—Timothy F. Simone
*Assistant Examiner*—Tony G. Soohoo
*Attorney, Agent, or Firm*—Collard & Roe

[57] ABSTRACT

A mop wringer has a long lever operating handle and mounts on the rear wall of a bucket. When so mounted the wringer is supported on the side walls of the bucket at or towards the front of the wringer by support ledges integrally moulded into the side walls of the bucket, below its upper rim. The wringer engages the bucket in a manner which opposes the tendency for the back of the wringer to lift off the bucket when an operating force is applied to the wringer handle.

8 Claims, 5 Drawing Sheets

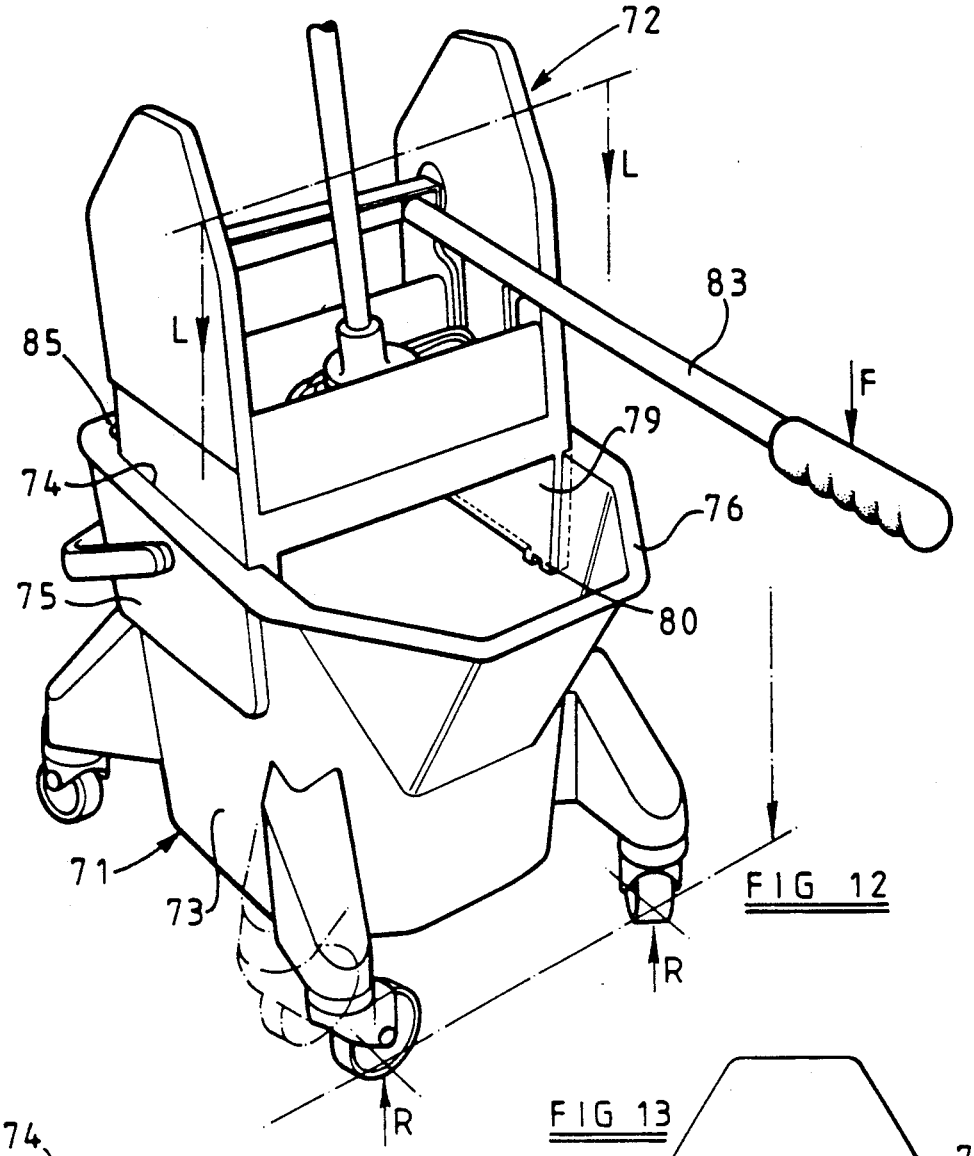
FIG 12
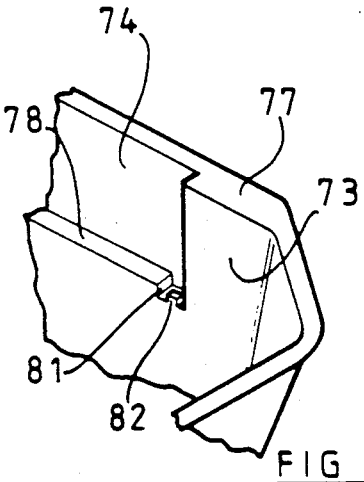
FIG 14
FIG 13
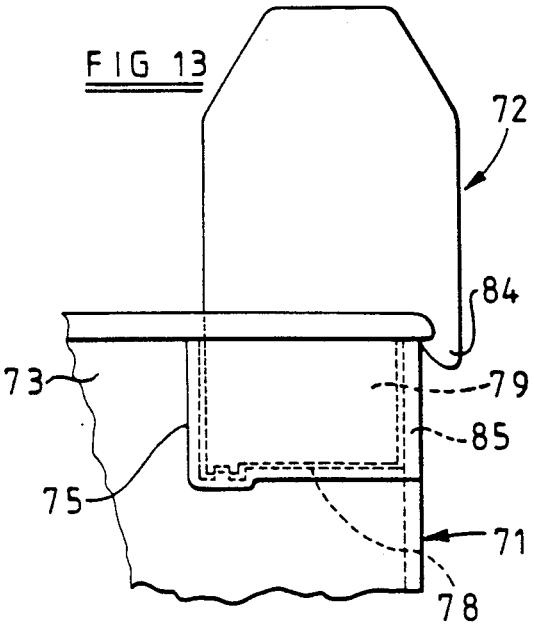

MOP WRINGERS AND BUCKETS

This is a continuation-in-part of copending application Ser. No. 07/655,326 filed on Feb. 12, 1991, now abandoned.

BACKGROUND OF THE INVENTION

1. Field of the Invention

The invention relates to mop wringers and buckets for use in wet mopping. It is particularly concerned with wringers of the type which mount on a mop bucket and which are manually operated, by means of a lever handle, to squeeze out into the bucket a mop inserted in the wringer.

2. Description of the Prior Art

Known wringers of the foregoing type mount only on the rear wall of the bucket, which is therefore severely stressed with a buckling force which has to balance the operating force applied to the wringer handle. Thus the length of the handle which can be used is limited by the necessity of avoiding over-stressing of the bucket wall, which in turn limits the squeeze pressure which can be applied to a mop. A further disadvantage is that yielding of the bucket wall results in a non-positive yielding "feel" when applying the operating force to the handle.

SUMMARY OF THE INVENTION

A principal aim of the invention is to provide a wringer mounting which enables a longer operating handle to be employed with a resultant improved wringing-out action.

According to the invention there is provided a mop wringer arrangement, wherein the wringer has a lever operating handle, mounts on the rear wall of a bucket and is supported on the side walls of the bucket at or towards the front of the wringer, with engagement of the wringer with the bucket opposing a tendency for the back of the wringer to lift off the bucket when an operating force is applied to the wringer handle, support of the wringer at or towards the front thereof being provided by a supporting formation of the bucket. Preferably the mounting of the wringer on the rear wall of the bucket provides the engagement which opposes the tendency for the back of the wringer to lift.

Front support of the wringer is provided by a supporting formation of the bucket, for example by integrally moulded internal support ribs or ledges.

As the operating moment applied to the wringer handle is no longer withstood by bending and buckling forces applied to the rear wall of the bucket, but by an upward tension at the rear wall and downward compressive forces at the side walls, a longer handle can be used and a more solid "feel" is provided as the operating force is applied. The longer leverage thus obtained enables a wringer to be manufactured with which the average cleaning operative can achieve a completely wrung-out mop, whereas with present handle lengths mops are commonly incompletely wrung out. At the same time thinner bucket walls will often suffice with a moulded bucket, thus saving on the cost of the moulding material and providing a cheaper bucket construction.

As the length of the handle is increased the front floor support of the bucket may have to be moved forwardly to prevent the bucket tipping over towards the operative when operating the wringer. Thus the forward floor support may be positioned in a lateral plane which is disposed in front of the bucket and which preferably contains the position on the handle to which the operative force is applied with the handle at the wringing position.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWINGS

FIGS. 12 and 13 are similar views to FIGS. 10 and 11 respectively of an alternative embodiment of the invention; and FIG. 14 is a part perspective view of the bucket of the embodiment of FIGS. 12 and 13.

DESCRIPTION OF THE PREFERRED EMBODIMENTS

Figure 1:
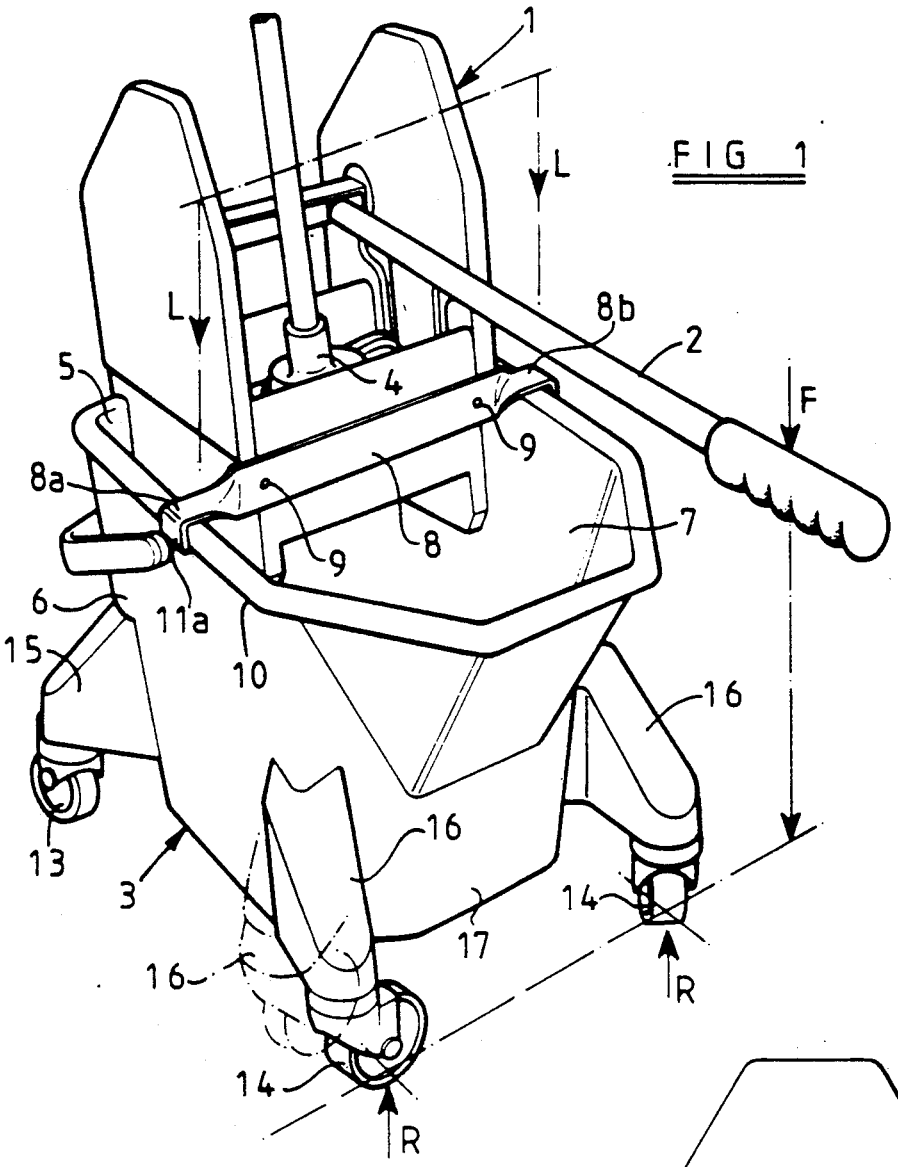
FIG. 1 is a perspective view of a hand-operated wringer mounted on a mop bucket.

FIG. 1 illustrates a hand-operated wringer 1 with an operating lever handle 2 and which mounts on top of a mop bucket 3 as shown. Movement of the handle from a generally upright resting position (not shown) to the more or less horizontal and forwardly projecting position ("wringing" position) illustrated applies a squeeze pressure to a mop, such as 4, inserted in the wringer 1 from above. The wringer 1 is of conventional general construction and hence is not further described herein except for the novel features associated with the invention.

In accordance with the invention the wringer 1 mounts on the rear wall 5 of the moulded plastics bucket 3, and is supported at the front on the bucket side walls 6 and 7. Such front support is provided by a cross member 8 which is fixed at the front of the wringer 1, by suitable fixings 9 such as screws or rivets, and which rests on the rim 10 of the bucket. The ends **8*a* and 8*b* of the cross member 8 hook over and seat on the rim 10 so as to oppose any tendency for the side walls 6 and 7** to spread apart during a wringing operation.

Figure 3A:
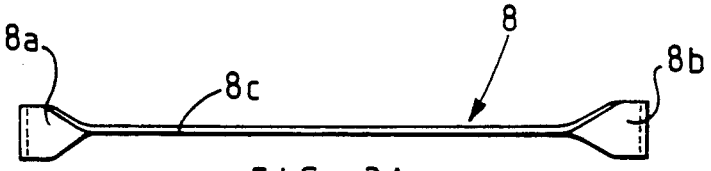
FIGS. 3A and 3B are respectively top and front views of a cross member of the arrangement of FIG. 1.
Figure 3B:
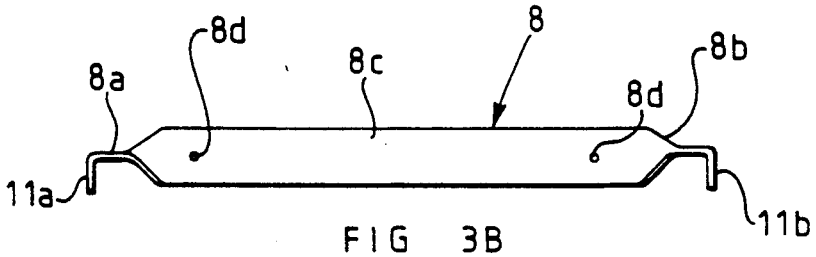

The cross member 8, which may be manufactured and supplied for attachment to existing wringers to provide the manifold advantages of the invention, is as shown more particularly in FIGS. 3A and 3B. As can be seen therefrom the member 8 is formed from a length of flat metal strip, for example being of galvanised mild steel, with end portions 8*a* and 8*b* twisted through 90° and then bent down at right angles to provide end flanges 11*a* and 11*b*. Thus the member 8 has end formations which hook over and seat on the bucket rim 10. The main flat body 8*c* of the member 8 has suitable fixing holes 8*d* for the described fixings 9.

Figure 2:
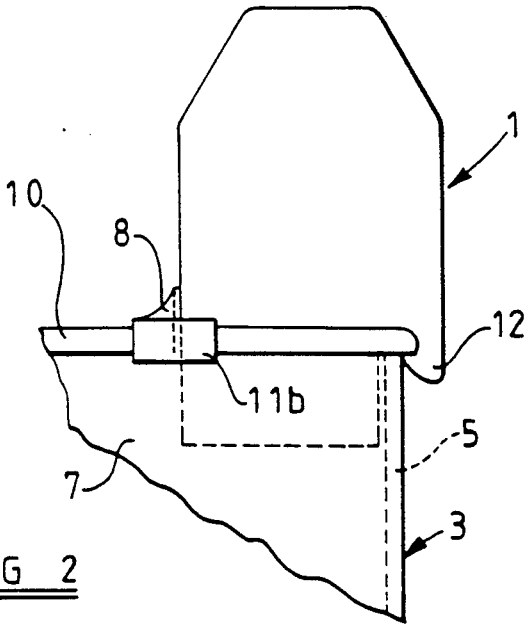
FIG. 2 diagrammatically illustrates a rear mounting of the wringer of FIG. 1.

The rear mounting of the wringer 1 on the rear wall 5 is such that it opposes a tendency for the back of the wringer 1 to lift off the bucket as the operating force is applied to the handle 2 as indicated by the arrow F. In FIG. 2 there is illustrated an example of a suitable rear mounting of the wringer 1, comprising a hook-like rear formation which as the wringer 1 is fitted hooks around and beneath the rim 10 of the bucket. This formation may be provided on each of two spaced mounting projections 12 at the rear of the wringer 1.

As a result of the rear mounting and front support of the wringer 1 the wringing force is distributed, largely as a compressive load on the bucket 3 by the cross member 8 as indicated by the arrows L in FIG. 1. As the wringing force is not withstood by buckling forces on the rear wall, as it is in a conventional arrangement, the wringing action has a "solid" feel and wringer deflection does not dissipate the wringing forces. Furthermore, a longer handle 2 can be employed which enables much greater wringing forces to be applied for given operative effect. The invention enables a handle to be used which in some circumstances can be of the order of twice the length of the handles as normally used in the past.

For mobility the bucket 3 is mounted on four corner castors, referenced 13 at the rear and 14 at the front. As can be appreciated from the view of FIG. 1, the increased length of the handle 2 not only increases the wringing efficiency but it facilitates use of the handle 2 for propelling and steering the bucket 3 on the castors 13, 14. The rear castors 13 are fitted to floor support outriggers such as 15 and the front castors 14 to outriggers 16. The outriggers are generally aligned with the rear wall 5, and normally the outriggers 16 would be similarly disposed with respect to the front wall 17 of the bucket 3, as is shown in broken lines for the left-hand corner in FIG. 1. However, in view of the increased length of the handle 2 the front castors 14 are moved forwardly, to prevent the bucket 3 tipping over forwardly when the operating force is applied to the handle 2. The outriggers 16 are now cranked to extend forwardly so that the front floor reaction forces indicated by the arrows R lie in a lateral plane, in front of the main body volume of the bucket 1, which plane also contains the arrow F. Thus the castors are effectively brought into line with the vertical handle load to prevent the bucket tipping.

Figure 4:
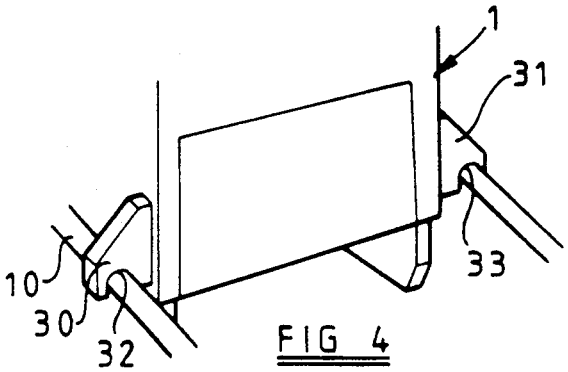
FIGS. 4 and 5 are partial views illustrating another form of wringer mounting.
Figure 5:
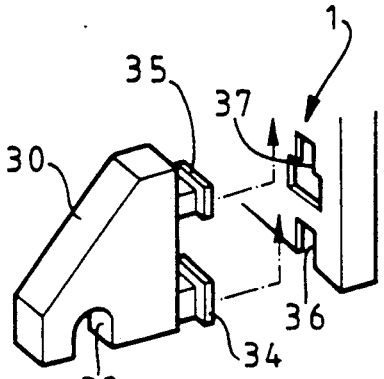

In the modification of FIGS. 4 and 5 outrigger support members 30 and 31 are positioned at the two sides near to the front of the wringer 1. Each support 30 or 31 has a lower recess, 32 or 33, which seats on the bucket rim 10 to provide the same advantages as the cross member 8 of the arrangement of FIGS. 1 to 3. However, in this case the rim 10 is engaged on both its inner and outer sides so that the support members 30 and 31 act to strengthen the bucket side walls against both inward and outward movement and thus provide particularly firm lateral relative location of wringer and bucket. The cross member of the earlier embodiment may if desired be modified so that it likewise engages on both sides of the rim 10. The supports 30 and 31 are detachably secured to the wringer 1, each having a plug-in connection thereto as shown in FIG. 5. Flanged projections 34 and 35 respectively engage at a lower open ended slot 36 and an upper keyhole slot 37 at the sides of the wringer.

Figure 6:
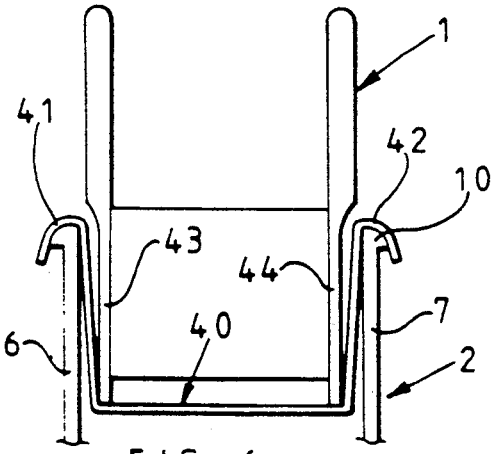
FIGS. 6 and 7 are diagrammatic views respectively illustrating two further forms of wringer mounting.

FIG. 6 illustrates how the front support of the wringer 1 may be provided by a separate saddle member or sling 40 which at the ends 41 and 42 hooks over the side walls 6 and 7. The member 40 extends below the wringer 1 under wringer cheek plates 43, 44 near the front thereof to provide direct vertical support. The support member 40 may be sufficiently rigid to tie in the bucket sides and thus oppose any tendency for outward spreading of the side walls 6 and 7.

Figure 7:
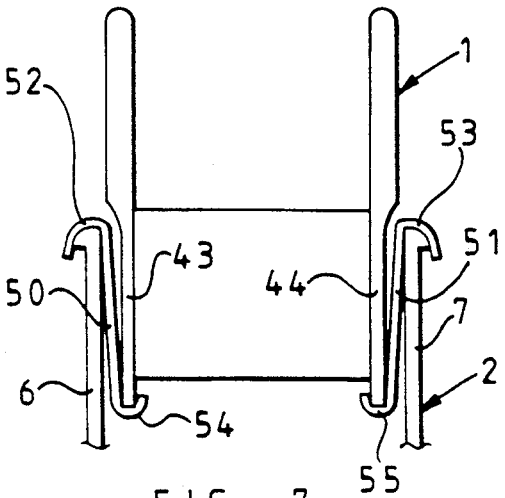

In the embodiment of FIG. 7, the single separate saddle member 40 is in effect split into two double-hook like members 50 and 51. At the upper ends 52 and 53 the members 50 and 51 respectively hook over the bucket side walls 6 and 7. At the lower ends 54 and 55 the members 50 and 51 respectively hook under the cheek plates 43 and 44 near to the front of the wringer 1.

Figure 8:
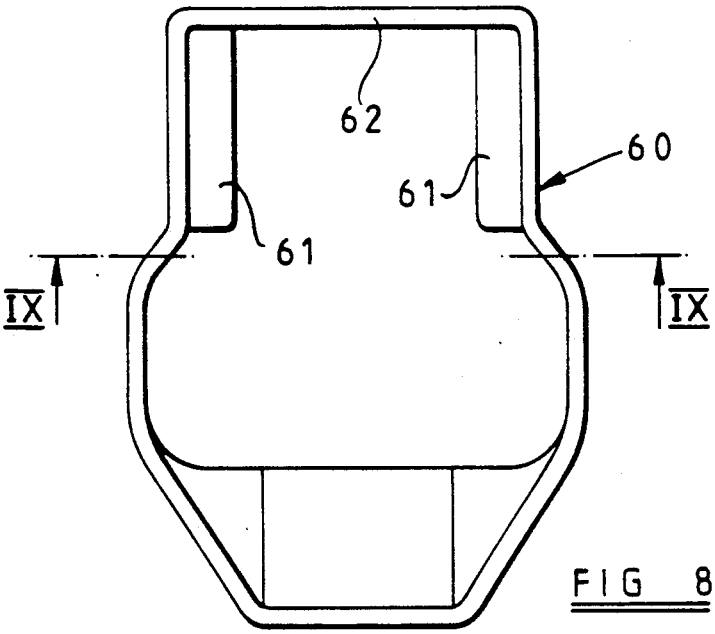
FIG. 8 is a plan view of a bucket of a mop wringer arrangement in accordance with the present invention.
Figure 9:
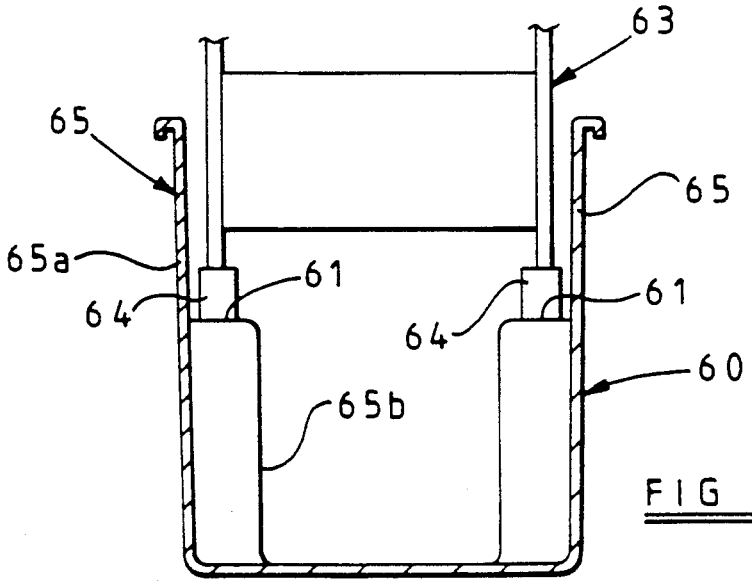
FIG. 9 is a diagrammatic front view with the bucket sectioned on the line IX—IX in FIG. 8.

The embodiment of FIGS. 8 and 9 employs a design of bucket which enables the advantages of the invention to be achieved with an existing wringer construction. The bucket 60 is moulded with internal ledges 61 at the sides, these ledges 61 extending from the bucket rear wall 62 for a distance slightly greater than that spanned by the wringer 63. Front feet 64 of the wringer 63, which are normally provided to enable the wringer to be stood on the floor when not in use, respectively rest on the ledges 61. This supports the wringer 63 on the bucket side walls 65, of which the ledges 61 form part, at the front in accordance with the invention. The wringer 63 mounts on the rear wall 62 as before.

As may be seen from FIG. 9, each ledge 61 is in the form of a step which extends generally horizontally between the lower end of an upper part 65*a* of the side wall and the upper end of a lower part 65*b* of the side wall. As best seen in FIG. 8, each ledge 61 is of substantially constant width and extends parallel to its respective side wall.

Figure 10:
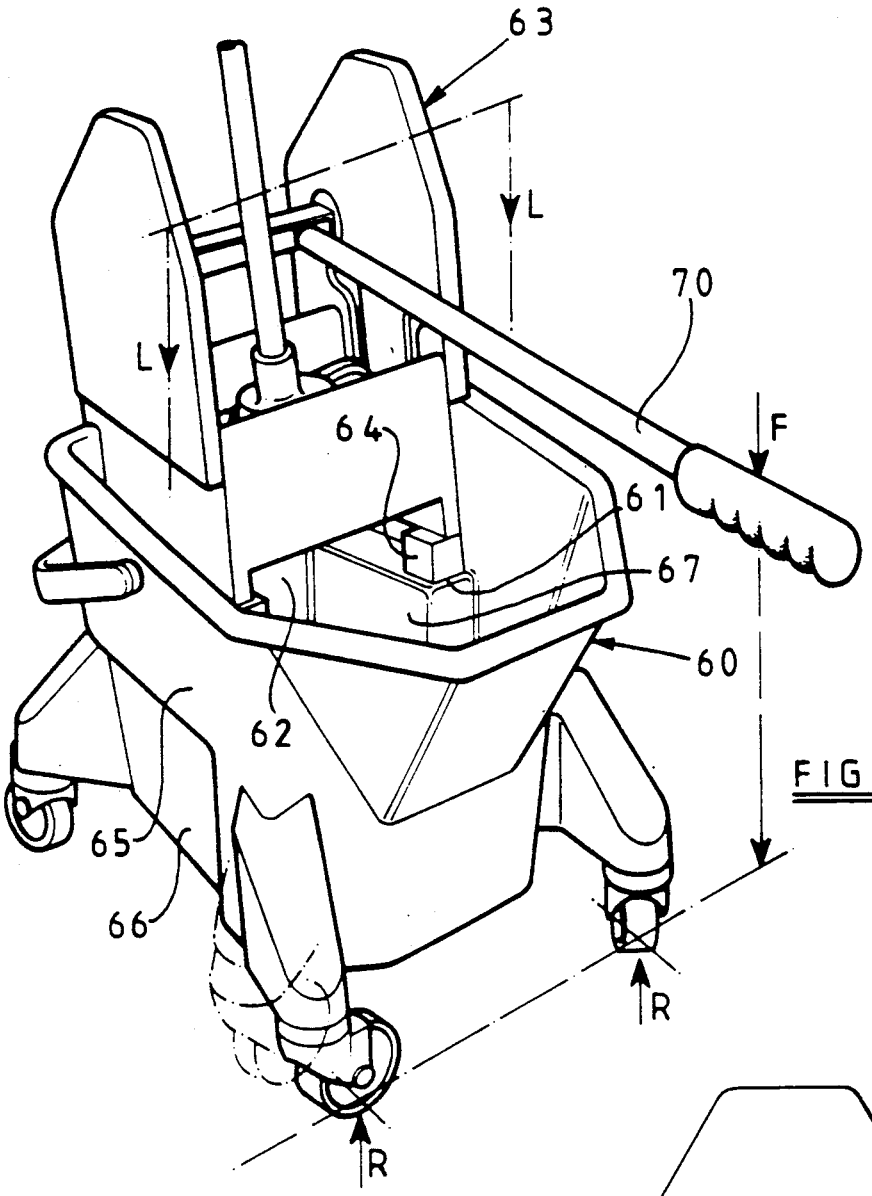
FIG. 10 is a more detailed perspective view of a mop wringer arrangement similar to that of FIGS. 8 and 9.

FIG. 10 is a perspective view of a mop wringer and bucket arrangement which is a slightly modified version of the embodiment of FIGS. 8 and 9. In this case the forward end of the wringer 63 is supported on ledges 61 integrally moulded into the side walls 65 of a bucket 60 which is of similar general configuration to the bucket 3 illustrated in FIG. 1. The ledges 61 are provided on the internal surfaces of the side walls 65 by moulding the external surfaces of the side walls with generally rectangular recesses 66 which result, due to the side walls being of substantially constant thickness, in corresponding generally rectangular projections 67 on the inside of the bucket, the supporting ledges 61 comprising the top surfaces of such projections.

Figure 11:
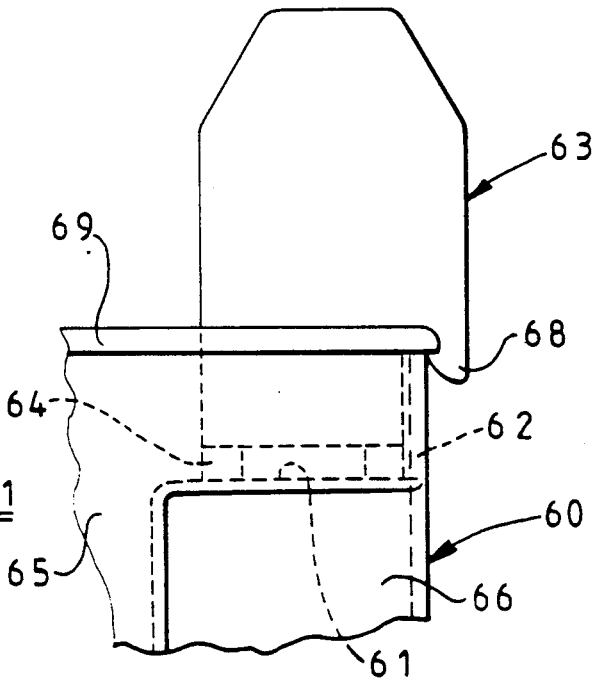
FIG. 11 is a side view of the upper rear part of the arrangement of FIG. 10.

FIG. 11 shows a side elevation of the wringer 63 and the rear upper part of the bucket 60. As in the arrangements of FIGS. 1 and 2 the rear of the wringer 63 is provided with two spaced mounting projections 68 which fit over the top of the rear wall 62 of the bucket and engage beneath the rim 69 around the top edge of the bucket to prevent the rear of the wringer lifting upwardly from the bucket. Since the side ledges 61, moulded integrally with the plastics bucket, support the front legs 64 of the wringer 63, the wringer is solidly mounted and fully supported on the bucket so as to permit the use of a long handle 70 to increase the force that can be applied to the wringing device to achieve efficient wringing of the mop without risking damage to the walls of the bucket 60.

FIGS. 12–14 show a modified version of the mop and wringer arrangement shown in FIGS. 8–11.

In the arrangement of FIGS. 12–14 the bucket 71 and wringer 72 are generally similar to the bucket and wringer of FIGS. 1 and 10 but in this case the ledges supporting the wringer within the bucket 71 are differently formed. In this arrangement the upper parts of the side walls 73 of the bucket are formed with generally rectangular internal recesses 74, as best seen in FIG. 14, which, due to the material of the walls of the bucket being of substantially constant thickness, result in generally rectangular projections 75 on the external surfaces of the bucket walls 73. Although the side walls are of substantially constant thickness the shaped upper rim 76 of the bucket is widened forwardly of the recesses 74, as indicated at 77 in FIG. 14, so as to form a smooth continuation of the rim as it passes alongside the recess 74 and onto the portion of the side wall in front of the recess.

As best seen in FIG. 14 the bottom surface of each recess 74 provides an upwardly facing ledge 78 on which rests the lower edge surface of depending side flanges 79 on the lower part of the wringer 72. The side flanges 79 are shaped overall so as generally to fit snugly within the recesses 74. As best seen in FIG. 12, the thickness of each flange 79 is slightly greater than the depth of the associated recess 74.

In order to assist in locating the flanges 79 in their respective recesses 74, the forward lower corners of the flanges 79 are formed with downward extensions 80 which are received in downward extensions 81 of the recesses 74. An upstanding abutment 82 in the bottom of each recess extension 81 engages a corresponding abutment surface on the flange 79 to prevent the flange 79 slipping inwardly out of the recess as a result of the application of substantial downward pressure on the forward end thereof which results from application of a large downward force on the lever 83.

As in the previously described arrangement, the rearward part of the wringer 72 is formed with downward projections 84 which hook the rear of the wringer on to the rear wall 85 of the bucket 71.

In all of the embodiments of FIGS. 8 to 14, the bucket is moulded from a suitable plastics material, and the supporting ledges are integrally moulded into the side walls of the bucket.

In that it enables a longer handle to be fitted to the wringer the invention has important ergonomic advantages in addition to that of better wringing-out of a mop. Thus the invention provides excellent benefits for people regularly using mop bucket and wringers, particularly in lessening the back strain commonly suffered by cleaning operatives. Not only can a given or improved wringing action be achieved with far less effort than hitherto, but the handle can be operated higher up so that less stooping is involved when wringing out a mop.

While I have illustrated and described my invention in preferred forms, it will be apparent that the same are subject to alteration and modification without departing from the underlying principles involved, and I accordingly do not desire to be limited to the specific details illustrated and described except as may be necessitated by the appendant claims.

What is claimed is:

1. A mop wringer arrangement comprising:

a bucket having a rear wall, side walls, and a front wall, each of said walls having a respective internal surface, an external surface and an upper edge;

a wringer for removable mounting on said rear wall of said bucket, the wringer including pressure applying means operatively connected to as lever-type handle which is movable from a generally upright resting position to a forwardly projecting wringing position so that, in use, movement of the handle from said resting position to said wringing position applies a squeeze pressure to a mop inserted in the wringer from above;

the wringer further comprising spaced side flanges which, when the wringer is mounted on the rear wall of the bucket, extend downwardly into the bucket and lie closely adjacent the side walls respectively of the bucket, the flanges having a respective rear edges which then lie closely adjacent the rear wall of the bucket;

the wringer being further provided with downward projections, spaced rearwardly of said rear edges of the side flanges, which projections, when the wringer is mounted on the bucket, extend downwardly adjacent the external surface of the rear wall of the bucket;

support ledges integrally formed on the internal surfaces of the side walls respectively of the bucket and spaced substantially below said upper edges of the side walls;

said side flanges of the wringer having lower edges which, when the wringer is mounted on the rear wall of the bucket, engage and rest on said support ledges, whereby the wringer is partly supported by said ledges.

2. A mop wringer arrangement according to claim 1, wherein each side wall of the bucket comprises an upper part having a lower end and a lower part having an upper end, each said support ledge being formed by a step in the side wall which extends generally horizontally between said lower end of the upper part of the side wall and said upper end of the lower part of the side wall.

3. A mop wringer arrangement according to claim 2, wherein the internal surface of said upper part of each side wall is formed with a recess having an upwardly facing bottom surface which defines said step in the side wall, each recess, when the wringer is mounted on the rear wall of the bucket, at least partly receiving a respective one of said side flanges on the wringer, with said lower edge of the respective side flange resting on said bottom surfacer of the respective recess.

4. A mop wringer arrangement according to claim 2, wherein said upper part of each side wall of the bucket is of substantially the same thickness as said lower part of the side wall.

5. A mop wringer arrangement according to claim 1, wherein each support ledge extends only part way along the length of the respective side wall of the bucket in a direction away from said rear wall and towards said front wall of the bucket.

6. A mop wringer arrangement according to claim 5, wherein each support ledge extends from the rear wall of the bucket forwardly along the length of the respective side wall and only part way towards the front wall of the bucket.

7. A mop wringer arrangement according to claim 1, wherein each support ledge is of substantially constant width and extends parallel to its respective side wall.

8. A mop wringer arrangement according to claim 1, wherein the bucket has two floor support outriggers adjacent said front wall of the bucket, and the handle has a length to extend forwardly beyond the front wall of the bucket when in said wringing position.

* * * * *